United States Patent [19]

Shiba et al.

[11] 3,933,510

[45] Jan. 20, 1976

[54] SPECTRALLY SENSITIZED SILVER HALIDE PHOTOGRAPHIC EMULSION

[75] Inventors: Keisuke Shiba; Haruo Takei; Akira Sato; Tadashi Ikeda, all of Minami-ashigara, Japan

[73] Assignee: Fuji Photo Film Co., Ltd., Minami-ashigara, Japan

[22] Filed: Sept. 4, 1973

[21] Appl. No.: 394,016

[30] Foreign Application Priority Data

Sept. 4, 1972 Japan ..... 47-88528

[52] U.S. Cl. ..... 96/124; 96/132; 96/137

[51] Int. Cl.[2] ..... G03C 1/14

[58] Field of Search ..... 96/124, 132

[56] References Cited

UNITED STATES PATENTS

| | | | |
|---|---|---|---|
| 3,397,060 | 8/1968 | Schwan et al. | 96/124 |
| 3,713,835 | 1/1973 | Sato et al. | 96/124 |
| 3,718,475 | 2/1973 | Shiba et al. | 96/124 |
| 3,729,319 | 4/1973 | Jefferson et al. | 96/124 |
| 3,769,024 | 10/1973 | Sakazume et al. | 96/124 |
| 3,799,783 | 3/1974 | Hill et al. | 96/124 |
| 3,814,609 | 6/1974 | Shiba et al. | 96/124 |

*Primary Examiner*—J. Travis Brown

*Attorney, Agent, or Firm*—Sughrue, Rothwell, Mion & Zinn

[57] ABSTRACT

A silver halide photographic emulsion which contains in combination a supersensitizing amount of at least one pseudocyanine sensitizing dye and at least one oxacarbocyanine sensitizing dye.

11 Claims, 12 Drawing Figures

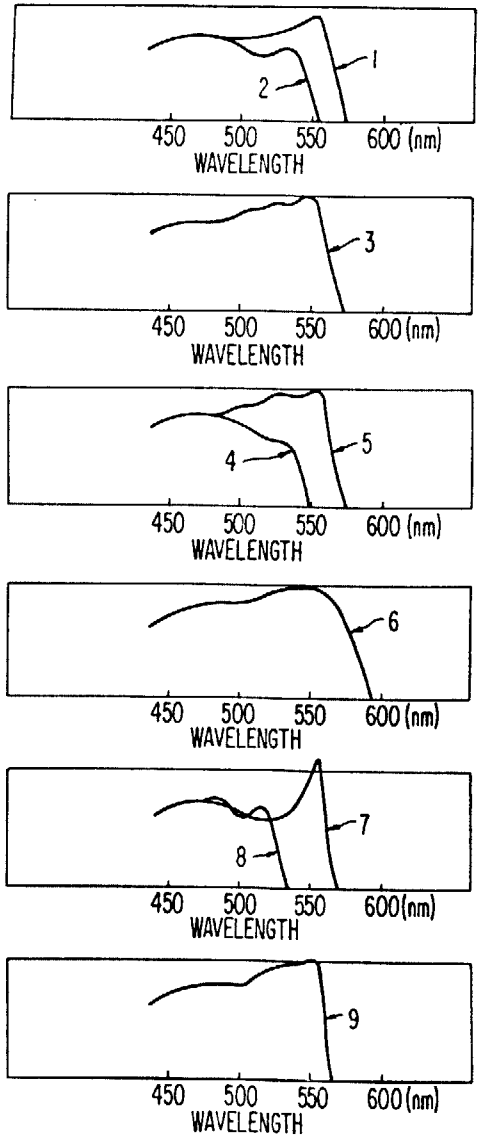
FIG. 1
FIG. 2
FIG. 3
FIG. 4
FIG. 5
FIG. 6
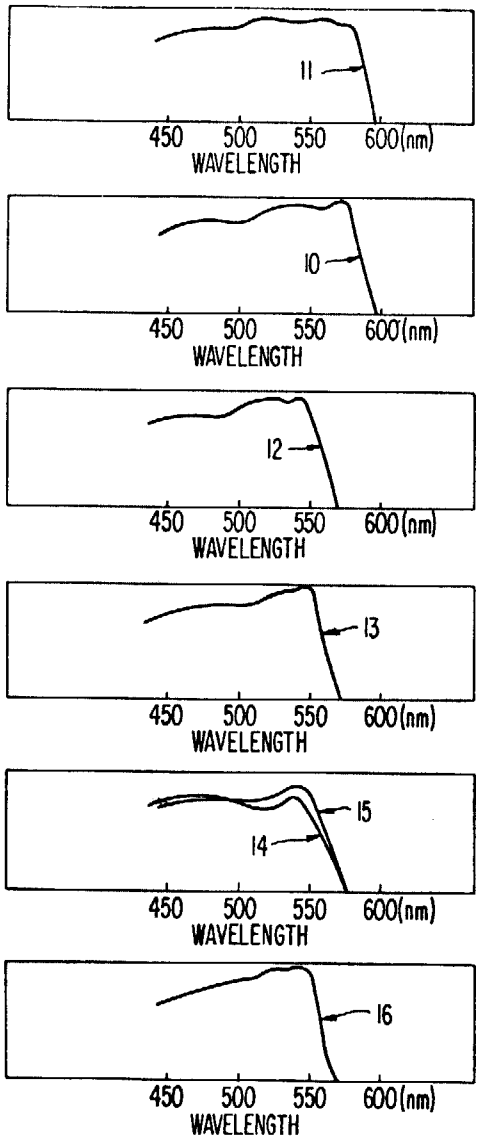
FIG. 7
FIG. 8
FIG. 9
FIG. 10
FIG. 11
FIG. 12

SPECTRALLY SENSITIZED SILVER HALIDE PHOTOGRAPHIC EMULSION

BACKGROUND OF THE INVENTION

1. Field of the Invention

The present invention relates to a gelatino-silver halide photographic emulsion spectrally sensitized by the combination of at least two sensitizing dyes which show a supersensitization action to each other. More particularly, it relates to a silver halide photographic emulsion, particularly for color light-sensistive light-sensitive materials, which has an enhanced spectral sensitivity in the green wave-length region, particularly, at wave-lengths of 500 to 540 nm.

2. Description of the Prior Art

It is known that the sensitivity of the green-sensitive emulsion layer and the spectral distribution thereof greatly influence the color reproducibility of, particularly, color light-sensitive materials (for example, color reproduction of fresh lawn green, discrimination between this lawn green and the dark green of pinetree needles, the degree of fidelity in the color reproduction of objects which are artificially colored green, and the like). Many attempts have been made to improve such color reproducibility. One example thereof is the sensitization of a silver halide emulsion for use in green sensitive layer, which is described in, e.g., Japanese Patent Publication No. 4936/68, 33753/69; U.S. Pat. Nos. 3,397,060, 3,628,964; 3,580/724; 3,617,294; 3,663,210, and 3,666,480. Another example thereof is to enhance the sensitivity of the silver halide emulsion for use in the green sensitive layer in the wave-length region of from 500 to 540 nm. Much effort has been directed to this purpose, which are described in, e.g., U.S. Pat. Nos. 3,617,294 and 3,679,301, German Patent OLS Nos. 2,011,879, and 2,053,187, etc. A further example thereof is to reduce the so-called "remaining of dye" (the stain caused by the dye remaining after development processing) resulting from the sensitizing dye contained in the color light-sensitive materials.

Conventional approaches developed for solving these problems still involve many defects. One of these defects is that where the spectral sensitivity distribution obtained by the supersensitizing combination of an imidazolocarbocyanine dye and a pseudo cyanine dye extends too far in the long wave-length region, it reaches, for example, 580–610 nm, and that the sensitivity at about 545 nm, which is the wave-length of maximum human visual sensitivity and sensitivity in the wave-length region of from 500 to 540 nm are insufficient. When the J-band of the imidazolocarbocyanine dye is partitioned to effect a blue-shift in order to remove this defect as described in, e.g., Japanese Patent Publication No. 1999/71, the sensitivity-inhibiting action by the copresent magenta coupler emulsion is increased. On the other hand, when the peak of J-band is shifted to the short wave-length side by the action of the substituent at the benzimidazole nucleus of the imidazolocarbocyanine dye (e.g., by the introduction of an alkoxycarbonyl group illustrated in the dye described in German Patent Publication No. 2,011,879), the sensitivity-inhibiting action by the copresent magenta coupler emulsion is also increased. Another defect is that pseudocyanine dyes are inherently particularly susceptible to the sensitivity-inhibiting action of the copresent magenta coupler emulsion as compared with other cyanine dyes (this sensitivity-inhibiting action being based on substitution at the 5-position of the benzothiazole or benzoselenazole nucleus of the pseudocyanine), and that copresence of the emulsion thereof increases the remaining of dye. In addition, it is known that, in supersensitization using a pseudocyanine dye, a strict selection of the chemical structure of the pseudocyanine dye is required depending upon the other sensitizing dye combined with the pseudocyanine dye.

In order to remove these defects, the combined use with an oxacarbocyanine dye having a specific chemical structure is employed (which is described in, e.g., German Patent OLS Nos. 2,127,671, 2,135,413, etc.).

An object of the present invention is to remove the above-described various defects. The objects of the invention have been attained by the discovery of a novel system of pseudocyanine dye which causes a much stronger supersensitization particularly with an oxacarbocyanine dye. That is, the desired objects can be attained by incorporating in a silver halide emulsion the combination of at least one sensitizing dye represented by the following general formula (I);

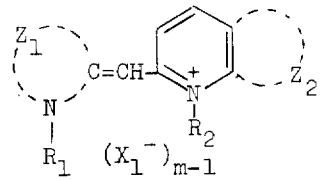

(I)

wherein $Z_1$ represents a benzothiazole nucleus or benzoselenazole nucleus wherein the carbon atom at the 5-position is substituted by a halogen atom (e.g., a chlorine atom, a bromine atom, etc.), an alkoxycarbonyl group (e.g., a methoxycarbonyl group, an ethoxycarbonyl group, etc.), a cyano group, a trifluoromethyl group or a group having a positive Hammet's constant 6 p (other than a nitro group) (e.g., methylsulfonyl, etc; and acetyl group and a monoaryl group, e.g., phenyl, etc.), such as 5-chlorobenzothiazole, 5-chloro-6-methylbenzothiazole, 5-trifluoromethylbenzothiazole, 5-cyanobenzoselenazole, 5-methoxy-carbonylbenzothiazole, 5-bromo-benzoselenazole, 5-cyano-6-chlorobenzoselenazole nucleus, and the like; $Z_2$ represents the non-metallic atoms necessary to form a benzene nucleus, thus forming a quinoline nucleus (which can be substituted with substituents such as a lower alkyl group (e.g., methyl, etc.), a halogen atom (e.g. fluorine, bromine, chlorine, etc.), a hydroxy group, a lower alkoxy group (e.g., methoxy, etc.) and a lower alkyl amino group (e.g., methylamino, diethylamino, etc.) such as quinoline, 6-methylquinoline, or the like which is commonly used in pseudocyanine dyes; $R_1$ and $R_2$ each represents an aliphatic group including a saturated aliphatic group and an unsaturated aliphatic group for example an alkyl group having 1–6 carbon atoms and a substituted alkyl group (e.g. a lower alkyl group such as a methyl group, an ethyl group, a propyl group; a substituted lower alkyl group, e.g., a phenethyl group, a p-sulfophenethyl group, a sulfopropyl group, a 3-sulfobutyl group, a 4-sulfobutyl group, a 3-sulfo-2-hydroxypropyl group, a 5-sulfo-2-acetoxypentyl group, 2-hydroxy-3-sulfatopropyl group, a 2-carboxyethyl group, a carboxymethyl group, 2-hydroxyethyl group, a 2-cyanoethyl group, a p-carboxyphenethyl group, etc. which are substituted by a sulfo group, a hydroxy group, an acetoxy group, a sulfato group, a carboxy group, an aryl group, a cyano group or the like), at least one of $R_1$ and $R_2$ being an lower alkyl group having a sulfo group in either the acid or salt form (e.g., Na, K, etc. salts, amine (e.g. ammonium, triethylamine, etc.) salts; $X_1^-$ represents an anion necessary to form a cyanine dye salt, such as a mineral acid anion (e.g., an iodide ion, a bromide ion, a perchlorate ion, etc.) and an organic acid anion (e.g., a p-toluene sulfonate ion, a benzenesulfonate ion etc.) *m* represents 1 or 2 and, when the dye forms an intramolecular salt, *m* represents 1; and at least one sensitizing dye represented by the following general formula (II);

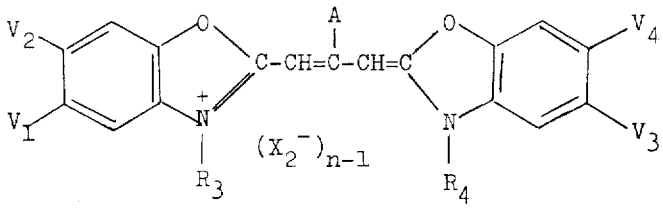

(II)

wherein $V_1$ represents a halogen atom (e.g., chlorine atom, a bromine atom, a fluorine atom, etc.), a trifluoromethyl group, a phenyl group, an alkoxycarbonyl group (e.g., in which the alkyl moiety has 1 to 5 carbon atoms e.g., a methoxycarbonyl group, an ethoxycarbonyl group, etc.); $V_2$ and $V_4$ each represents a hydrogen atom or a lower alkyl group (e.g., a methyl group, an ethyl group, etc.); $V_3$ represents a halogen atom, a trifluoromethyl group, a phenyl group, an alkoxycarbonyl group, e.g., in which the alkyl moiety has 1 to 5 carbon atoms, a lower alkyl group (e.g., a methyl group, an ethyl group, etc.), an alkoxy group (e.g., in which the alkyl moiety has 1 to 5 carbon atoms e.g., a methoxy group, an ethoxy group, etc.), a hydroxy group, or a hydrogen atom; at least one $V_1$, $V_2$, $V_3$ or $V_4$, preferably being substituted by a halogen atom, a phenyl group, or an alkoxycarbonyl group; A represents a methyl group, an ethyl group or a propyl group; $R_3$ and $R_4$ each represents the same groups as defined for $R_1$ and $R_2$, at least one of $R_3$ and $R_4$ being lower alkyl group having a sulfo group or a carboxyl group in either the acid or salt form (e.g., Na, K, etc. salts, amine (e.g., ammonium, triethylanine, etc.) salts; $X_2^-$ represents the same groups as defined in $X_1^-$; *n* represents 1 or 2 and, when the dye forms an intramolecular salt, *n* represents 1; with the dyes of the general formulas (I) and (II) being present in such amounts that the combination exhibits a supersensitizing action to each other as used herein, the term lower alkyl is used to described an alkyl group wherein the alkyl moiety has from 1 to 5 carbon atoms.

BRIEF DESCRIPTION OF THE DRAWINGS

FIGS. 1–12 contain spectrograms obtained as described in the Examples with curves 3, 5, 6, 9, 10, 11, 12, 13, 15 and 16 showing spectrograms of the supersensitizing dye combination of the present invention and with Curves 1, 2, 4, 7, 8, and 14 showing spectrograms of dye combinations outside the invention for comparison.

DETAILED DESCRIPTION OF THE INVENTION

The pseudocyanine dyes represented by the general formula (I) tend to form J-aggregate as compared with the pseudocyanine dyes described in German Patent OLS Nos. 2,135,413, 2,049,967, 2,127,671, and 2,011,879, and are characterized in that they provide a stong J-band. In general, pseudocyanine dyes scarcely exhibit any supersensitizing action even when used in combination with an oxacarbocyanine dye. However, the pseudocyanine dyes represented by the general formula (I) selectively exhibit supersensitizing action to the oxacarbocyanine dyes represented by the general formula (II) which tend to provide a J-band, and the sensitivity can be maintained at a high level in the system in which a magenta coupler is present. In addition, the pseudocyanine dyes in accordance with the invention have the advantage that there is less remaining of yellow dye after development processing.

The combination of the dyes in accordance with the invention can be used further in combination with conventionally known dyes such as the imidazolooxacarbocyanine dyes, imidazoloindocarbocyanine dyes, imidazolocarbocyanine dyes, non-symmetrical thiaoxacarbocyanine dyes, non-symmetrical imidazolothiacarbocyanine dyes or non-symmetrical imidazoloselenacarbocyanine dyes. For example, the combination of the present invention can be used in combination with the dyes described in Japanese Patent Publication Nos. 4936/68, and 32753/69, Japanese Patent Application Nos. 1320/71, 16424/71 and 6315/72, corresponding German respectively to U.S. patent applications Ser. No. 219,047 filed Jan. 19, 1972 Ser. No. 237,041, filed Mar. 21, 1972 and Ser. No. 321,423, filed Jan. 5, 1973. German Patent Nos. 2,159,615, 2,011,879, and 2,053,187; U.S. Pat. Nos. 3,397,060, 3,628,964, 3,580,724, 3,617,294 3,663,210, 3,666,480, and 3,679,301.

Specific examples of the dyes used in the invention are illustrated below.

[IA]

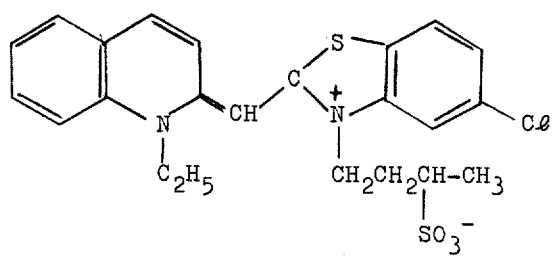

[IB]

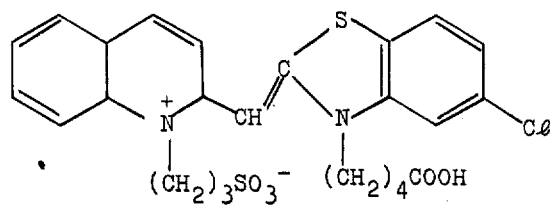

Continued
[IC]
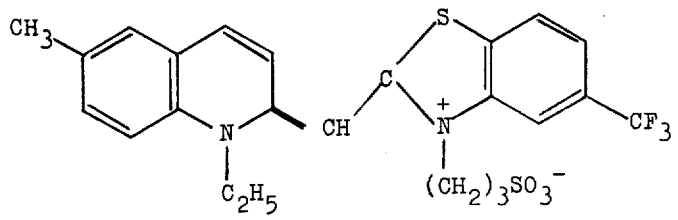
[ID]
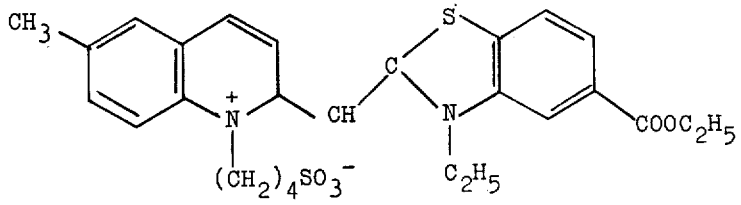
[IE]
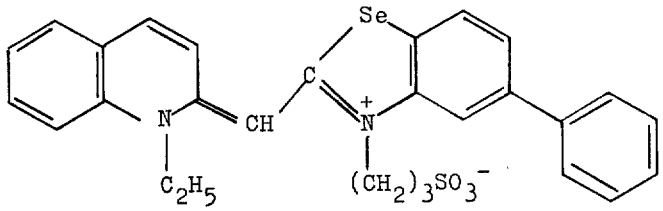
[IF]
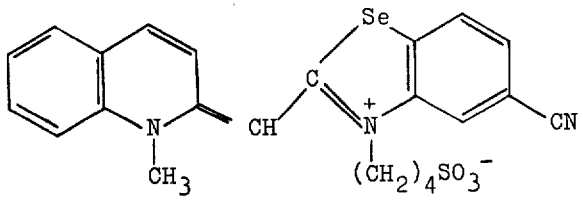
[IIA]
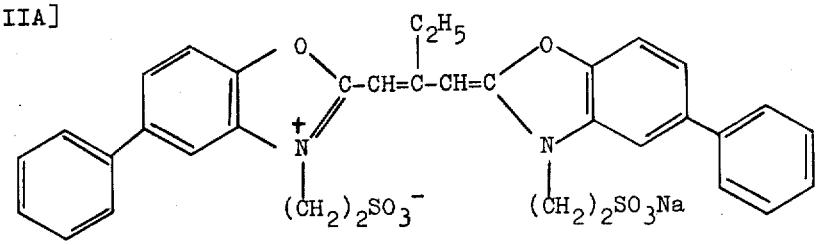
[IIB]
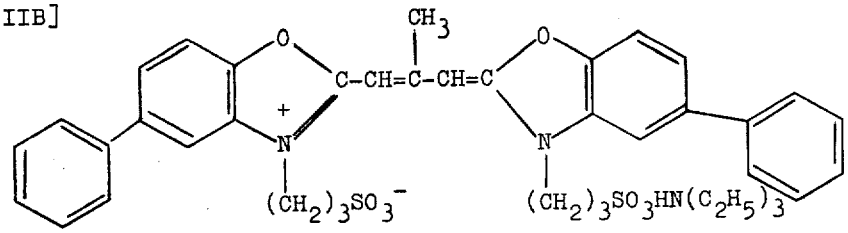

Continued
[IIC]
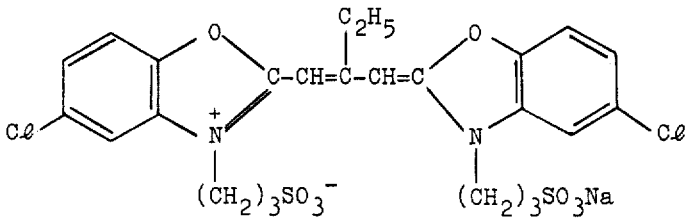
[IID]
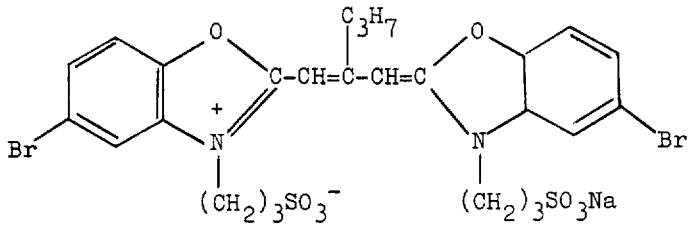
[IIE]
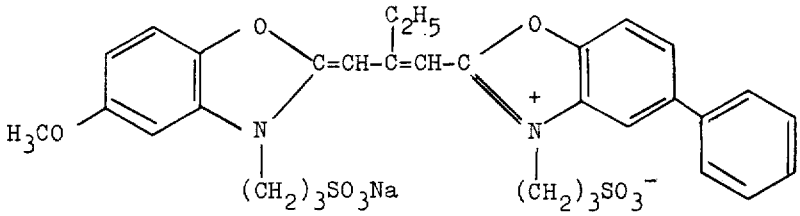
[IIF]
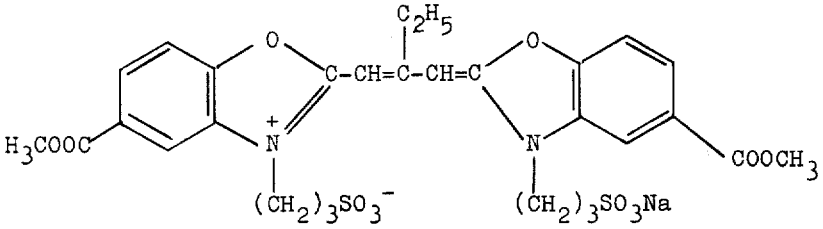
[IIG]
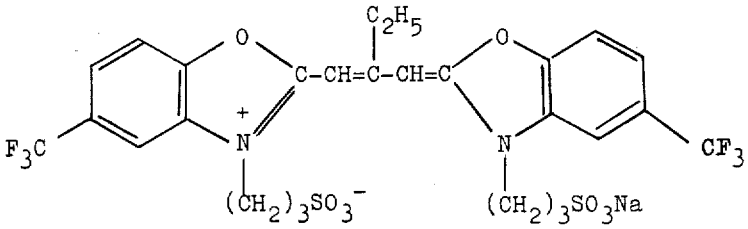
[IIH]
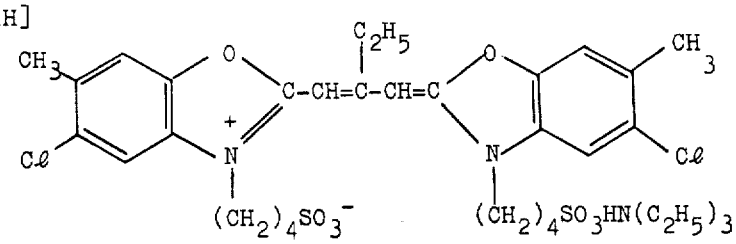

Continued

[II I]

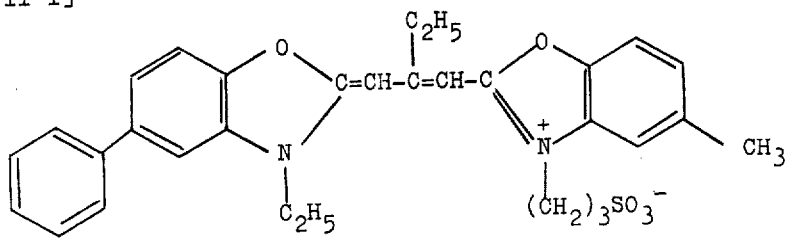

As the sensitizing dyes to be additionally used in the present invention, there are the following:

(III A)

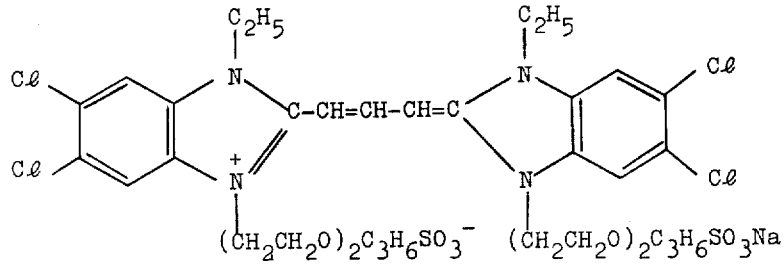

(III B)

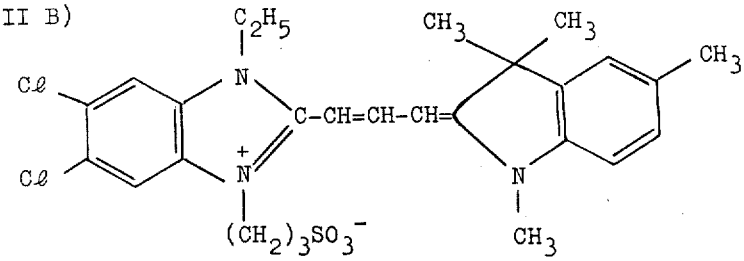

(III C)

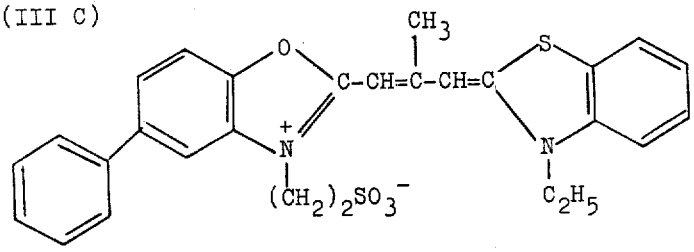

Also the sensitizing dyes as set forth below of the formulae (III-A – III-C) can be used additionally with the sensitizing combination of dyes of the general formulae (I) and (II) of this invention and additional embodiment of this invention. These sensitizing dyes used additionally with the sensitizing combination of the pseudocyanine dye and the oxacarbocyanine dye of the invention provide additional advantages in that when the sensitizing dyes of the formula III-A, III-B or III-C are employed are that a sensitizing wavelength region is extended or maximum sensitivity wavelength is shifted toward longer wavelength. Sensitizing dyes for comparison:

(A)

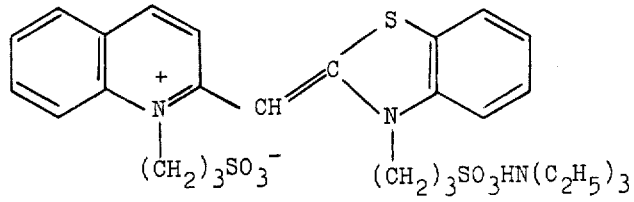

Continued (B)

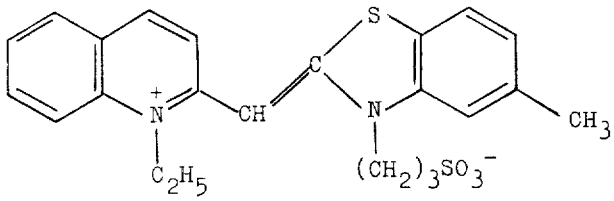

The silver halide photographic emulsion to be used in the present invention are those which are produced in the conventional manner and contain grains of silver chloride, silver bromide, silver iodide or of silver halide mixtures which have been precipitated using the simple jet method, the double jet method or a combination thereof followed by ripening. (See Mees "The Theory of Photographic Process" MacMillan; Grafkide's "Photographic Chemistry" Fauntain Press) Preferably, a silver bromoiodide emulsion or a silver bromochloroiodide emulsion is used. It is particularly preferred that the silver halide contain at least 90 mol % silver bromide and less than 7 mol % silver iodide A preferred halogen composition in mol % of iodide ranges no more than 10 mol %, for example from 2 mol % to 7 mol %. The preferred mean particle size of the grains in number (measured by a projected area method in a conventional way) is about 0.04 to about 2 microns.

To the silver halide photographic emulsion to be used in the invention, conventionally employed chemical sensitization, i.e., gold sensitization, sensitization with Group VIII metal ions, sulfur sensitization, reduction sensitization or a combination thereof can be applied. Specific examples of chemical sensitizing agents are sulfur sensitizing agents such as allyl thio carbamide, thiourea, sodium thiosulfate, cystine, etc., for example, as described in U.S. Pat. Nos. 1,574,944; 2,278,947; 2,440,206; 2,410,689; 3,189,458; and 3,415,649; noble metal (complex) salts such as potassium chloroaurate, aurous thiosulfate, potassium chloropalladate, etc., for example as described in U.S. Pat Nos. 2,540,085; 2,597,876; 2,597,915; and 2,399,083; reducing agents such as tin chloride, phenylhydrazine, reductone, etc., for example as described in U.S. Pat. Nos. 2,518,698; 2,419,974; and 2,983,610; and the like. In addition, such sensitizing agents as polyoxyethylene derivatives, polyoxypropylene derivatives (as disclosed in U.S. Pat. No. 271606), organic compounds having an oxonium or ammonium group (as disclosed in U.S. Pat. Nos. 2,271,623; 2,288,226; and 2,334,864), hydroquinone derivatives, hydroxyamine derivatives, etc. are also effective. The emulsion of the invention can further contain antifoggants such as nitrobenzimidazole, ammonium chloroplatinate, etc., stabilizers such as 4-hydroxy-6-methyl-1,3,3a, 7-tetrazaindene, thiazolium salts as disclosed in U.S. Pat. Nos. 2,131,038 and 2,694,716, azaindenes as disclosed in U.S. Pat. Nos. 2,886,437 and 2,444,605, urazoles as disclosed in U.S. Pat. No. 3,287,135, sulfocatechols as disclosed in U.S. Pat. No. 3,236,652, oximes, mercapto tetrazoles as disclosed in U.S. Pat. Nos. 2,403,927, 3,266,897, and 3,397,987, nitrons, nitroindazoles, polyvalent metal salts as disclosed in U.S. Pat. No. 2,839,405, thiuronium salts as disclosed in U.S. Pat. No. 3,220,839, salts of metals such as palladium, platinum and gold as disclosed in U.S. Pat. Nos. 2,566,263 and 2,597,915, organic and inorganic hardeners such as formaldehyde, chromium alum, 1-hydroxy-3,5-dichlorotriazine, sodium salt, glyoxal, dichloroacrolein, etc., coating acids such as saponin, alkylaryl sultonates such as the as disclosed in U.S. Pat. No. 2,600,831 and amphoteric compounds as disclosed in U.S. Pat. No. 3,133,816 sodium alkylbenzenesulfonates, etc.

Where the silver halide emulsion of the present invention is used as the green-sensitive emulsion layer in a coupler in the emulsion type color light-sensitive materials, the emulsion contains a compound which provides a magenta color image upon development processing, i.e., a color coupler, generally in an amount ranging from about 2 mol to about 0.01 mol per 1 mol of silver. As the color coupler, there are compounds having a pyrazolone nucleus described in U.S. Pat. Nos. 2,600,788, 2,455,170, 3,311,476, 3,408,194, 3,447,928, etc., compounds having an indazolone nucleus e.g.,

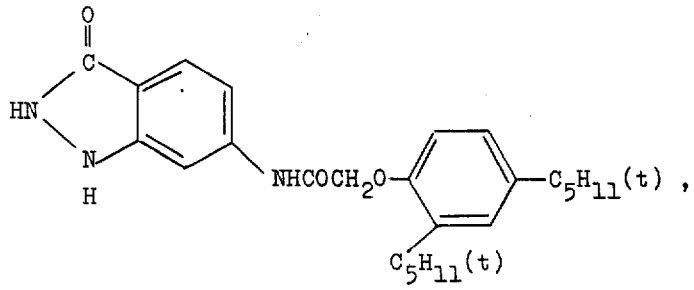

DIR-type couplers, as disclosed in U.S. Pat. Nos. 3,006,759, 3,148,062, 3,227,551, 3,227,554, 3,009,958, 3,043,690, 3,701,783, 3,379,529, 3,297,445, 3,364,022, 3,620,746, 3,551,157, 3,615,506, 3,632,345, 3,622,328, 3,617,291, 3,632,373 and 3,705,801 and British Patent No. 1,269,073, and the like.

The silver halide emulsion of the invention can contain, as the protective colloid, gelatin; gelatin derivatives such as phthaloylated gelatin, malonylated gelatin, etc.; cellulose derivatives such as hydroxymethyl cellulose, carboxymethyl cellulose, etc.; soluble starch such as dextrin, etc.; synthetic polymers such as polyvinyl alcohol, vinyl pyrrolidone, polyacrylamide, polystyrenesulfonic acid, etc. and, as the plasticizer, synthetic polymers such as acrylic acid-styrene copolymers, acrylonitrile-methacrylic acid copolymers, alkyl acrylate-acrylic acid copolymers, etc. Also, a latex polymer can be incorporated as a dimension stabilizer or a matting agent. The finished emulsion is applied to a suitable support such as a baryta paper, a resin-coated paper, a synthetic paper, a cellulose triacetate film, a polyethylene terephthalate film, a glass plate, or other plastic bases. A preferred ratio by weight of silver halide to the protective colloid ranges from 1:4 to 4:1 with the emulsion being coated on a support in a amount preferably ranging from about 3–4 $\mu$.

The sensitizing dyes used in the invention are added to the emulsion by dissolving the dyes in water or in a water-mixcible organic solvent (e.g., methanol, ethanol, methyl cellosolve, pyridine, acetone, etc.). Also, they can be added by the method described in German Patent OLS No. 2,104,283 or U.S. Pat. No. 3,649,286.

The dyes can be added in the usual sensitizing amount but, preferably, in an amount of from $1 \times 10^{-3}$ mol to $1 \times 10^{-6}$ mol per 1 mol of silver halide, for example, a sensitizing dye of the formula (I) at a level of from $1 \times 10^{-5}$ to $1 \times 10^{-3}$ mol, a sensitizing dye of the formula (II) at a level of from $1 \times 10^{-5}$ to $5 \times 10^{-4}$ mol per mol of silver halide, respectively. The molar ratio of the amount of the dye represented by the general formula (I) to that of the dye represented by the general formula (II) can be the amount generally used for super - sensitization but preferably is 10:1 to 1:100. The above described imidazolooxacarbocyanine dye, imidazoloindocarbocyanine dye, imidazolocarbocyanine dye, non-symmetrical thiaoxacarbocyanine dye, non-symmetrical selenaoxacarbocyanine dye, non-symmetrical imidazolothiacarbocyanine dye, or non-symmetrical imidazoloselenacarbocyanine dye can be used in combination in a molar proportion sufficient to achieve sensitization preferably, a range of 1:1 to 1:100 based on the amount of the dye of the general formulae (I) and (II).

The present invention will now be illustrated in greater detail by reference to the following examples, but the invention is not to be interpreted as being limited thereby in any way. Unless otherwise indicated, all parts and percents are by weight.

EXAMPLE 1

A high sensitive silver bromoiodide photographic emulsion was obtained according to a conventional method. The silver halide grains which were contained in this emulsion contained 6 mol% (halogen content) of iodine and had a mean particle size of 0.78 micron. This emulsion contained 0.58 mol of silver halide per 1 kg of the emulsion.

1 Kg of this silver halide emulsion was weighed out in a pot, which was then placed in a 50°C water bath for melting of the emulsion. While maintaining the temperature at 40°C and with stirring, the sensitizing dyes set forth in Table 1, as a methanol solution, were added thereto in the amounts described in Table 1. Further, 750 g of an emulsion of 1-(2,5-dichloro-4-methylphenyl)-3-[3-(2,4-di-tert-amylphenoxymethylamido)-benzamido]-5-pyrazolone (color coupler) was added thereto, and 0.01 g of 4-hydroxy-6-methyl-1,3,3a,7-tetrazaindene was added thereto as an aqueous solution. Then, 0.01 g of 1-hydroxy-3,5-dichlorotriazine sodium salt was added thereto as an aqueous solution. Further, 0.1 g of saponin and 0.1 g of sodium dodecylbenzenesulfonate were added thereto as an aqueous solution followed by stirring.

The coupler emulsion was prepared as follows. 2.5 Grams of dodecylbenzenesulfonic acid was added as an aqueous solution to 1 kg of a 10% by weight gelatin aqueous solution. Separately, 80 g of aforesaid coupler was dissolved in a mixed solution of 100 cc of tricresyl phosphate and 50 cc of ethyl acetate. Further, 2 g of sorbitan monolaurate was dissolved therein. This solution was added to the aforesaid gelatin aqueous solution, stirred at high speed and subjected to ultrasonic wave agitation for emulsification. Thus, there was obtained the emulsion.

The thus obtained finished emulsion was coated on a cellulose triacetate film base in a dry thickness of 5 microns followed by drying to obtain a sample of the light-sensitive material.

The resulting sample was cut into strips. One strip was wedge-exposed for 1/200 second using a sensitometer having a light source of color temperature of 5400°K, with the light source being covered with a yellow filter and a blue filter. Another strip was wedge-exposed using a monochromatic light of 535 nm in wave-length using a spectrosensitometer. The remaining strip was exposed using a grating-type spectrograph so as to obtain a spectrogram.

The strips were then subjected to the following color development processing to obtain magenta negative images.

| Color Development Processing Steps: | | |
|---|---|---|
| (1) Color Development | 24°C | 12 min. |
| (2) Stopping Bath | 24°C | 4 |
| (3) Hardening Bath | 24°C | 4 |
| (4) Washing | 24°C | 4 |
| (5) Bleaching Bath | 24°C | 6 |
| (6) Washing | 24°C | 4 |
| (7) Fixing Bath | 24°C | 8 |
| (8) Washing | 24°C | 8 |
| (9) Drying | | |
| **Composition of the Color Developer:** | | |
| Benzyl Alcohol | | 5 cc |
| Sodium Hydroxide | | 0.5 g |
| Diethylene Glycol | | 3 cc |
| Sodium Hexametaphosphate | | 2 g |
| Sodium Sulfite | | 2 g |
| Potassium Bromide | | 2 g |
| 4-Amino-3-methyl-N-ethyl-$\beta$-hydroxyethylaniline Sesquisulfate Monohydrate | | 5 g |
| Metaboric Acid | | 0.5 g |
| Borax | | 0.5 g |
| Water to make | | 1 liter |
| **Stopping Bath** | | |
| Sodium Acetate | | 30 g |
| Glacial Acetic Acid | | 8 cc |
| Water to make | | 1 liter |
| **Hardening Solution** | | |
| Sodium Hexaphosphate | | 1 g |
| Borax Pentahydrate | | 20 g |
| Formalin (37%) | | 10 cc |

-continued

| Color Development Processing Steps: | |
|---|---|
| **Bleaching Solution** | |
| Potassium Fericyanide | 30 g |
| Potassium Bromide | 20 g |
| Borax Pentahydrate | 15 g |
| Boric Acid | 5 g |
| Disodium Ethylenediaminetetracetate | 1 g |
| Water to make | 1 liter |
| **Fixing Solution** | |
| Sodium Hexametaphosphate | 1 g |
| Sodium Sulfite | 5 g |
| Sodium Thiosulfate | 150 g |
| Acetic Acid | 8 cc |
| Water to make | 1 liter |

The green filter density of the thus obtained magenta images was measured and the characteristic curves were determined to obtain the yellow filter relative sensitivity. Sy, the blue filter relative sensitivity, Sb, and the relative sensitivity to light of a wavelength of 535 nm, $S_{535}$. The results obtained are shown in Table 1. The density point where the sensitivity was determined was the point of [fog density + 0.2]. The sensitivities, Sy, Sb and $S_{535}$ are relatively shown by taking the Sy, Sb and $S_{535}$ of the emulsion containing $8 \times 10^{-5}$ mol of the Dye IIA as 100, respectively.

Table 1

| Run No. | Dye and the Amount Thereof Used (Shown in the parentheses in mol) | | | Sy | Sb | $S_{535}$ | Spectrogram |
|---|---|---|---|---|---|---|---|
| 1 | | IIA ($4\times10^{-5}$) | | 86 | 105 | 71 | |
| | | IIA($8\times10^{-5}$) | | 100 | 100 | 100 | 1 |
| | IA ($16\times10^{-5}$) | | | 22 | 76 | 32 | 2 |
| | IA ($8\times10^{-5}$) | IIA ($8\times10^{-5}$) | | 200 | 100 | 165 | 3 |
| | IA ($16\times10^{-5}$) | IIA ($8\times10^{-5}$) | | 168 | 69 | 142 | |
| 2 | IB ($8\times10^{-5}$) | | | 13 | 100 | 20 | |
| | IB ($16\times10^{-5}$) | | | 16 | 89 | 16 | 4 |
| | IB ($8\times10^{-5}$) | IIA ($8\times10^{-5}$) | | 224 | 105 | 168 | 5 |
| | IB ($16\times10^{-5}$) | IIA ($8\times10^{-5}$) | | 152 | 68 | 145 | |
| 3 | IB ($16\times10^{-5}$) | IIA ($8\times10^{-5}$) | IIIC ($2\times10^{-5}$) | 167 | 76 | 120 | 6 |
| | IB ($16\times10^{-5}$) | IIA ($8\times10^{-5}$) | IIIC ($4\times10^{-5}$) | 145 | 66 | 120 | |
| 4 | | IIC ($16\times10^{-5}$) | | 100 | 90 | 66 | 7 |
| | IC ($16\times10^{-5}$) | | | 25 | 92 | 32 | 8 |
| | IC ($16\times10^{-5}$) | IIC ($16\times10^{-5}$) | | 126 | 85 | 122 | 9 |
| 5 | IC ($16\times10^{-5}$) | IIC ($16\times10^{-5}$) | IIIA ($2\times10^{-5}$) | 200 | 83 | 132 | 10 |
| | IC ($16\times10^{-5}$) | IIC ($16\times10^{-5}$) | IIIA ($4\times10^{-5}$) | 160 | 66 | 132 | |
| 6 | IC ($16\times10^{-5}$) | IIC ($16\times10^{-5}$) | IIIB ($4\times10^{-5}$) | 177 | 100 | 125 | 11 |
| 7 | | IIF ($8\times10^{-5}$) | | 98 | 105 | 100 | |
| | ID ($16\times10^{-5}$) | | | 22 | 71 | 32 | |
| | ID ($16\times10^{-5}$) | IIF ($8\times10^{-5}$) | | 142 | 92 | 158 | 12 |
| 8 | | II I ($4\times10^{-5}$) | | 112 | 100 | 89 | |
| | | II I ($8\times10^{-5}$) | | 92 | 100 | 117 | |
| | IB ($8\times10^{-5}$) | II I ($8\times10^{-5}$) | | 120 | 78 | 155 | |
| | IB ($16\times10^{-5}$) | II I ($8\times10^{-5}$) | | 152 | 66 | 142 | 13 |
| 9 | | II D ($4\times10^{-5}$) | | 36 | 102 | 45 | |
| | | II D ($8\times10^{-5}$) | | 66 | 95 | 78 | |
| | IE ($16\times10^{-5}$) | | | 67 | 100 | 45 | 14 |
| | IE ($16\times10^{-5}$) | II D ($8\times10^{-5}$) | | 93 | 90 | 102 | 15 |
| 10 | | II M ($8\times10^{-5}$) | | 105 | 100 | 100 | |
| | IA ($8\times10^{-5}$) | II M ($8\times10^{-5}$) | | 132 | 92 | 126 | 16 |

EXAMPLE 2

Samples of a light-sensitive material were obtained in the same manner as described in Example 1 except that the addition of the coupler emulsion was omitted. The samples were subjected to development-processing at 20°C for 2 minutes using the following black-and-white developer. Then, the density was measured to obtain the results shown in Table 2.

| Composition of the Developer: | |
|---|---|
| Water | 500 cc |
| Metol | 2 g |
| Sodium Sulfite (anhydrous) | 90 g |
| Hydroquinone | 8 g |
| Sodium Carbonate Monohydrate | 52.5 g |
| Potassium Bromide | 5 g |
| Water to make | 1 liter. |

Table 2

| Dyes and the Amount used (in mol) | | Sy | Sb |
|---|---|---|---|
| | IIB ($8\times10^{-5}$) | 100 | 95 |
| IC ($16\times10^{-5}$) | IIB ($8\times10^{-5}$) | 158 | 100 |
| | IIC ($16\times10^{-5}$) | 112 | 100 |
| IA ($16\times10^{-5}$) | IIC ($16\times10^{-5}$) | 132 | 89 |
| A ($16\times10^{-5}$) | IIB ($8\times10^{-5}$) | 105 | 98 |
| B ($16\times10^{-5}$) | IIB ($8\times10^{-5}$) | 112 | 100 |
| A ($16\times10^{-5}$) | IIC ($16\times10^{-5}$) | 76 | 95 |
| B ($16\times10^{-5}$) | IIC ($16\times10^{-5}$) | 80 | 92 |

The density point where the sensitivity was determined was the point of [fog density + 0.2]. The sensitivity, Sy, of the emulsion is relatively shown by taking the Sy of an emulsion containing $8\times10^{-5}$ mol of the dye IIB as 100, and the sensitivity, Sb, is relatively shown taking Sb of the emulsion containing $16\times10^{-5}$ mol of the Dye IIC as 100.

The combination of the sensitizing dyes of the present invention which provides a supersensitizing action can be applied to the sensitization of the green layer in color light-sensitive materials such as non-incorporated-coupler type color reversal light-sensitive materials and incorporated-coupler type color reversal light-sensitive materials and in the light-sensitive materials for use in an in-camera-processing system containing a dye-developing agent. In addition, it can find application in the sensitization of silver halide emulsions used in black-and-white photographic light-sensitive materials, X-ray indirect photographic light-sensitive materials, materials for use as printing plates, materials for use in microsecond exposure system, materials for use in cathode ray, tube (CRT) systems, materials for use in holography, etc.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion which contains in combination at least one pseudocyanine sensitizing dye represented by the following general formula (I);

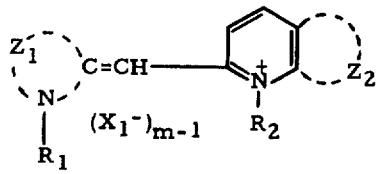

(I)

wherein $Z_1$ represents a benzothiazole nucleus or a benzoselenazole nucleus either of which is substituted at the 5-position by a halogen atom, an alkoxycarbonyl group, a cyano group, a trifluoromethyl group, a methylsulfonyl group, an acetyl group or a phenyl group; $Z_2$ represents the non-metallic atoms necessary to form a benzene nucleus; $R_1$ and $R_2$ each represents an aliphatic group, at least one of $R_1$ and $R_2$ being an alkyl group having a sulfo group; $X_1^-$ represents an anion; *m* represents 1 or 2 and, when the dye forms an intramolecular salt, *m* represents 1; and at least one oxacarbocyanine sensitizing dye represented by the following general formula

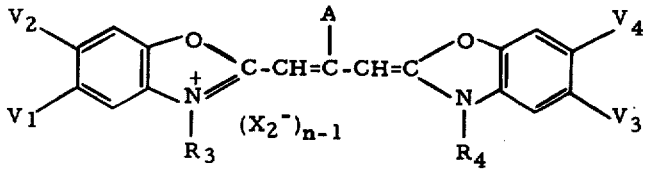

(II)

wherein $V_1$ represents a halogen atom, a trifluoromethyl group, a phenyl group, or an alkoxycarbonyl group; $V_2$ and $V_4$ each represents a hydrogen atom or an alkyl group; $V_3$ represents a halogen atom, a trifluoromethyl group, a phenyl group, an alkoxycarbonyl group, an alkyl group, an alkoxy group, a hydroxy group or a hydrogen atom; A represents a methyl group, an ethyl group or a propyl group; $R_3$ and $R_4$ each represents an aliphatic group, at least one of $R_3$ and $R_4$ being an alkyl group having a sulfo group or a carboxy group; $X_2^-$ represents an anion; *n* represents 1 or 2 and, when the dye forms an intramolecular salt, *n* represents 1; said dyes of the general formula (I) and of the general formula (II) being present in such amounts that the combination exhibits a supersensitizing action.

2. The silver halide emulsion as claimed in claim 1, wherein said emulsion additionally contains a magenta coupler, and wherein said sensitizing dye represented by the general formula (I) is present in said emulsion at a level of from $1 \times 10^{-5}$ to $1 \times 10^{-3}$ mol per mol of silver halide, and said sensitizing dye represented by the general formula (II) is present in said emulsion at a level of from $1 \times 10^{-5}$ to $5 \times 10^{-4}$ mol per mol of silver halide.

3. The silver halide emulsion as claimed in claim 1, wherein $Z_1$ represents the atoms necessary to form a benzothiozole nucleus substituted with a halogen atom, an alkoxycarbonyl group or a trifluoromethyl group or to form a benzoselenazole nucleus substituted with a phenyl group, $Z_2$ represents the atoms necessary to form a benzene ring which may be substituted with a lower alkyl group, $V_1$ represents a halogen atom, a phenyl group or an alkoxycarbonyl group, and $V_3$ represents a halogen atom, a trifluoromethyl group, a phenyl group, a lower alkyl group or an alkoxycarbonyl group.

4. The silver halide emulsion as claimed in claim 1, wherein said silver halide is at least 90 mol% silver bromide and is less than 7 mol% silver iodide.

5. The silver halide emulsion as claimed in claim 1, wherein the pseudocyanine dye of the formula (I) is selected from the group consisting of

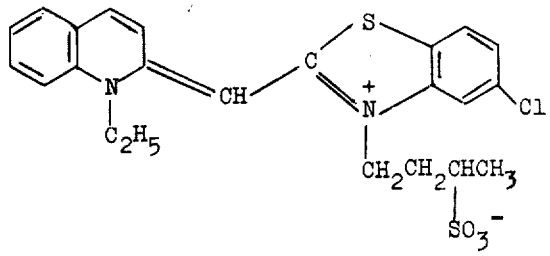

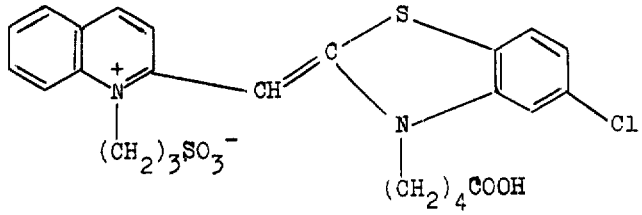

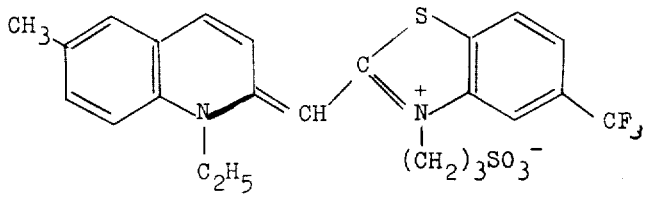
,
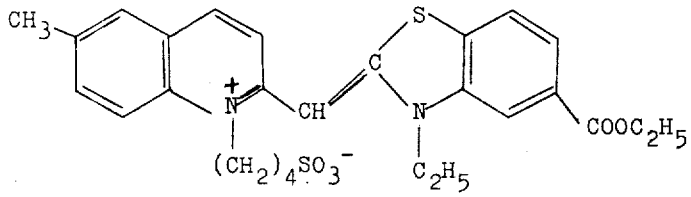
and
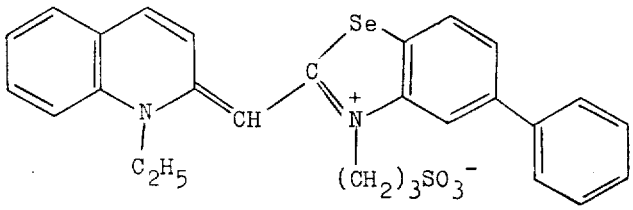
.
6. The silver halide emulsion as claimed in claim 1, wherein the oxacarbocyanine dye of the formula (II) is selected from the group consisting of
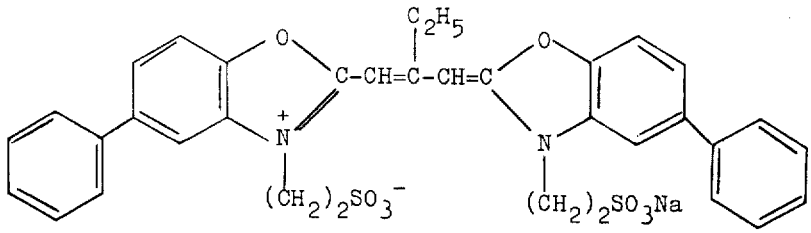
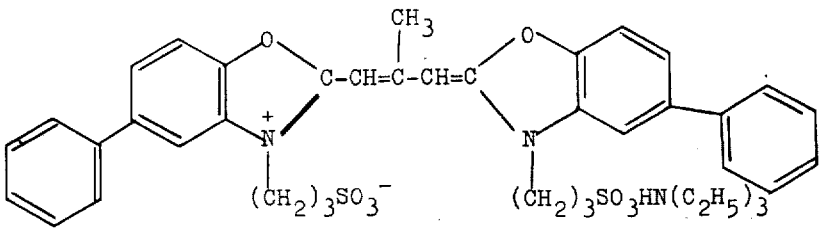
,
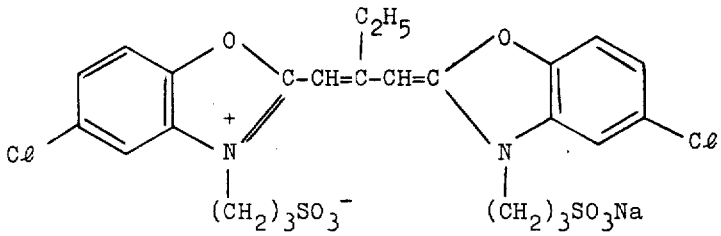
and
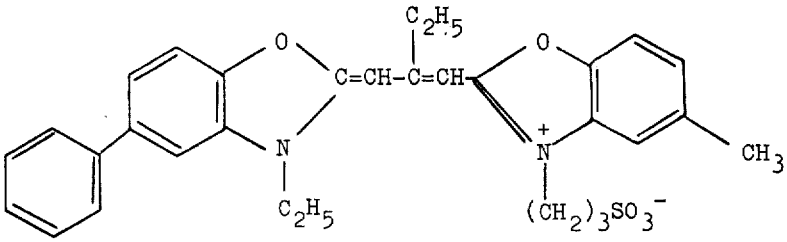
7. The silver halide emulsion as claimed in claim 1, wherein the emulsion further contains a dye of the following formula:

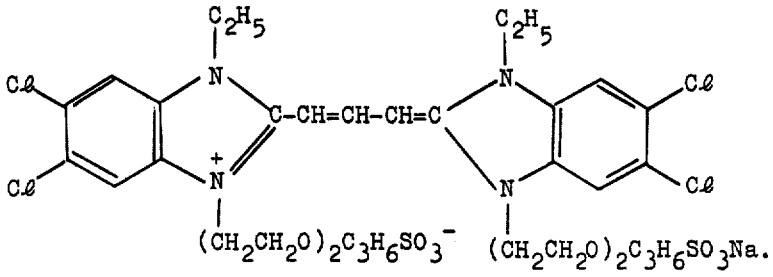

8. A silver halide photographic element comprising a support and having thereon the silver halide emulsion as claimed in claim 1.

9. The silver halide emulsion as claimed in claim 1 wherein the said combination consists essentially of said at least one pseudocyanine sensitizing dye and said at least one oxacarbocyanine sensitizing dye.

10. The silver halide emulsion of claim 9 wherein said at least one pseudocyanine sensitizing dye and said at least one oxacarbocyanine sensitizing dye are the sole sensitizing dyes required to achieve said super-sensitizing action.

11. The silver halide photographic element as claimed in claim 8 wherein said at least one pseudocyanine sensitizing dye and said at least one oxacarbocyanine sensitizing dye are the sole sensitizing dyes required to achieve said super-sensitizing action.

* * * * *